US007965308B2

(12) United States Patent
Jauert et al.

(10) Patent No.: US 7,965,308 B2
(45) Date of Patent: Jun. 21, 2011

(54) METHOD AND ARRANGEMENT FOR CONTROL OF THE PRINTING OF A THERMOTRANSFER PRINTING DEVICE

(75) Inventors: Joachim Jauert, Berlin (DE); Dirk Rosenau, Berlin (DE)

(73) Assignee: Francotyp-Postalia GmbH (DE)

( * ) Notice: Subject to any disclaimer, the term of this patent is extended or adjusted under 35 U.S.C. 154(b) by 1557 days.

(21) Appl. No.: 11/333,084

(22) Filed: Jan. 17, 2006

(65) Prior Publication Data

US 2006/0181718 A1 Aug. 17, 2006

(30) Foreign Application Priority Data

Feb. 15, 2005 (DE) ..... 10 2005 007 220

(51) Int. Cl.
*B41J 2/325* (2006.01)

(52) U.S. Cl. ..... 347/211

(58) Field of Classification Search ..... 347/211, 347/180, 181, 182; 400/120.05, 120.06
See application file for complete search history.

(56) References Cited

U.S. PATENT DOCUMENTS

| | | | |
|---|---|---|---|
| 4,630,068 | A | 12/1986 | Ims |
| 4,746,234 | A | 5/1988 | Harry |
| 5,453,776 | A | 9/1995 | Günther |
| 5,608,636 | A | 3/1997 | Guenther |
| 5,651,103 | A | 7/1997 | Arsenault et al. |
| 5,953,426 | A | 9/1999 | Windel |
| 6,041,704 | A | 3/2000 | Pauschinger |
| 6,406,120 | B2 | 6/2002 | Pauschinger |
| 6,733,194 | B2 | 5/2004 | Schilling et al. |
| 2004/0003740 | A1 | 1/2004 | Schilling et al. |

FOREIGN PATENT DOCUMENTS

| | | | |
|---|---|---|---|
| DE | 38 33 746 | A1 | 4/1990 |

*Primary Examiner* — Huan H Tran
(74) *Attorney, Agent, or Firm* — Schiff Hardin LLP

(57) ABSTRACT

In a method and an arrangement for controlling printing by a thermotransfer printing apparatus with relative movement between a thermotransfer print head and a print medium, a microprocessor that provides pixel energy data to a pixel energy memory by making an energy value calculation and by coding, and a print data controller prepares the pixel energy data by decoding during the printing in a number (corresponding to the pixel energy value) of binary pixel data each with the same binary value. The print data controller includes at least one pixel energy data preparation unit, a DMA controller, an address generator, a printer controller and a phase counter. The DMA controller allows an access to the pixel energy data stored in the pixel energy memory as code in order to provide the pixel energy data in print columns to the at least one pixel energy data preparation unit. The address generator generates addresses for selection of the buffered code during each phase of a number of phases. The phase counter supplies a phase count value to a phase data preparation unit in which the code value A and phase count value B are compared in order to generated binary pixel data, which are serially supplied from the output D to at least one shift register of the thermotransfer print head.

24 Claims, 7 Drawing Sheets

METHOD AND ARRANGEMENT FOR CONTROL OF THE PRINTING OF A THERMOTRANSFER PRINTING DEVICE

BACKGROUND OF THE INVENTION

1. Field of the Invention

The present invention concerns a method and an arrangement for controlling printing by a thermotransfer printing device. The invention is used in apparatuses with relative movement between a thermotransfer print head and the print medium, in particular in franking machines, addressing machines and other mail processing apparatuses.

2. Description of the Prior Art

A franking machine with a thermotransfer printing device that allows an easy changing of the print image information is known from U.S. Pat. No. 4,746,234. Semi-permanent and variable print image information are electronically stored in a memory as position data and are read out to the thermotransfer printing device for printout. The print image (franking stamp image) contains postal information including the postal rate data for transport of the postal item, for example a postal value character image, a postal stamp image with the postal delivery location and date as well as an advertisement image.

The entire print image is printed in print image columns by a single thermotransfer print head in a manner controlled by a microprocessor. The columns are presented in an arrangement orthogonally to the transport direction on a moving postal item. The machine can achieve a maximum throughput of franking items of 2200 letters/hour with a print resolution of 203 dpi.

The franking machine T1000 that is commercially available from Francotyp-Postalia GmbH has only one microprocessor for control of a 30 mm-wide thermotransfer print head with 240 heating elements for printing in columns. All heating elements lie in a row disposed orthogonally to the transport direction. For printing, thermotransfer printers use an equally wide thermotransfer ink ribbon disposed between a surface to be printed (for example a postal item) and the row of heating elements. Each heating element includes an electrical resistor. At the resistor of the activated heating element, the energy of an electrical pulse is converted into heat energy which transfers to the thermotransfer ink ribbon. Printing necessitates melting a small area of an ink layer of the thermotransfer ink ribbon and adherence of the melted ink on the print medium surface. The printing ensues only when the heating element charged with the pulse has been brought to printing temperature, i.e. a temperature higher than the preheating temperature. Given movement of the thermotransfer ink ribbon simultaneously with the postal item relative to the heating element and ongoing heat energy supply, a line or dash is printed parallel to the movement or transport direction. A line is printed orthogonally to the movement or transport direction in a print column when all heating elements in the row of heating elements are simultaneously charged with respective electrical pulses for a predetermined, limited time duration (pulse duration). The pulse duration can be subdivided into phases. A last phase (printing phase) in which the dots of a print column are printed exists within the predetermined, limited time duration (pulse duration). Additional phases of the activation of the heating elements in order to heat the heating element to printing temperature precede the last phase. The binary pixel data for activation of the heating elements of all print columns are stored in a volatile manner in a pixel memory. Given a low print resolution, the intervals of adjacent print columns are large and the binary pixel data of the print phase mirror the print image.

A longer single pulse can be divided into a number of pulses of equal pulse durations, each corresponding to a specific heating phase. Multiple phases are typically necessary in order to generate sufficient heat energy for melting a small portion of an ink layer under the heating element, to cause the melted ink to be printed on the surface of the postal item as a dot (DE 38 33 746 A1).

In principle, a high print resolution in each print phase can be achieved only when the activation of the heating elements for heating ensues in a timely manner in preceding phases. It should also be noted that the energy of an electrical pulse emitted to a heating element that is to be activated is likewise transduced at the resistor of the adjacent heating element in the row (heat conduction problem). The heat energy is reduced by cooling after the pulse has terminated. Due to the adjacent energy input by heat conduction, increasing the heat energy for the activation of specific heating elements in their heating phase may not be needed if sufficient heat energy is nevertheless present to effect melting of the ink layer area under that heating element. The microprocessor therefore also monitors and controls the energy distribution dependent on the pattern to be printed in addition to formulating and emitting binary pixel data for generation or non-generation of an electrical pulse. The original mirroring of the print image as binary pixel data is thereby suitably altered in the pixel memory so that a clean print image is created. This requires a comprehensive pre-calculation as is, among other things, known from DE 41 33 207.

A microprocessor with higher calculation speed could be used to achieve a higher print resolution. The output of binary pixel data to the thermoprinting head then would ensue more often per time unit during which a print medium is moved further by an equal portion of the transport path. The memory space requirement in the pixel memory, however, simultaneously increases due to the pixel data for each additional virtual column or heating phase. "Virtual column" means a further column in the print image that is not visible since it does not cause a dot to be printed in the heating phase.

The binary pixel data for activation of the heating elements in the printer of each printing column can be encoded into image information in a known manner and exist stored in the pixel memory in order to save storage space. A method for control of the per-column printing of a postal value character is known from EP 578 042 B1 (corresponding to U.S. Pat. No. 5,608,636), in which coded image information are converted into binary signals for activation of printing elements before each printing event. The converted variable and invariable image data are combined only during the printing. The decoding of the variable print data and provisioning of the print data for a complete column in a register thereby ensues via a microprocessor. Since the data for the next print column must be provided in the time between two print columns, calculation time of the microprocessor is required dependent on the amount of variable print data, the level of the franking item throughput and the print resolution. This increases the bus load and limits the possibility to print a franking stamp image faster on a franking item.

The processing burden on the microprocessor can be relieved by hardware for print control. A device and a method for per-column printing of an image in real time is known from U.S. Pat. No. 5,651,103 in which variable and fixed image data elements are connected with one another and stored in a buffer in order to then be used for printing a column. The variable and fixed image data elements are stored in a non-volatile memory, wherein a portion of the fixed image data elements is compressed. The print image data are assembled from variable and invariable image data by the hardware for the printing of each print column only just before its printing, meaning that the image data for a printing event do not exist in binary form in a memory area but instead exist in an encoded form comparable to the method disclosed for the T1000 in EP 578 042 B1. The variable image data elements in the non-volatile memory are identified by a controller, and data that correspond with the variable image data elements are transferred to the hardware in order to download the variable and fixed image data elements, to connect them with one another and then to print them. The hardware for this purpose requires a variable address register for each variable image data element. The number of the variable image elements is thus limited by the number of the address registers.

Since the commercial introduction of the franking machine T1000 in 1991 by Francotyp-Postalia, which allowed (for the first time) the aforementioned advertisement stamp image to be electronically changed at the touch of a button in addition to the date and the postal fees, the requirements for its microprocessor controller have continuously grown larger. The more data that are processed, the more variable data are required in the print image. It is also necessary to generate other print images that substantially differ in design and content from a franking stamp image in order, for example, to print out business cards, fee stamp images and legal expense stamp images. The requirements for the print resolution in dots per inch (dpi) continuously increase. Given the printing of a dot, the aforementioned heat conduction problem between the adjacent heating elements due to the pixels adjacent to the print image to be printed becomes even more significant the closer the adjacent pixels are. This problem associated with thermotransfer printing, increases at high print resolution.

Modern franking machines should enable printing of a security imprint, i.e. an imprint embodying a special marking in addition to the aforementioned information. For example, a message authentication code or a signature is generated from the aforementioned information and then a character string or a barcode is/are embodied in such a marking. When a security imprint is printed with such a marking, this enables a verification of the validity of the security imprint, for example in the post office or at a private carrier (as described in U.S. Pat. Nos. 5,953,426, and 6,041,704).

In some countries, the development of the postal requirements for a security imprint has had the consequence that the quantity of the variable print image data that must be changed between two imprints of different franking stamp images is very high. For example, for Canada a data matrix code of 48×48 image elements must be generated and printed for every single franking imprint.

For more rational postal distribution and to increase security against counterfeiting, a new standard called FRANKIT was introduced in 2004 in Germany by the Deutschen Post AG. In response, some franking machines the print resolution is increased by the use of a postal ½-inch inkjet print head with bubble jet technology that is arranged in a cartridge and is secured by suitable means (EP 1 132 868 A1).

A FRANKIT-compatible franking machine Ultimail® 60 is commercially available from Francotyp-Postalia that uses two modified 600 dpi inkjet print heads to generate a security imprint with 300 dpi print resolution (FIG. 1).

An arrangement to control printing in a mail processing device is known from EP 1 378 820 A2 (corresponding to U.S. Pat. No. 6,733,194) that has a print data controller for pixel data preparation during the printing with a print head. The print data controller is connected with a pixel memory via a bus. The circuit arrangement includes a DMA controller, a printer controller, as well as at least one pixel data preparation unit with two buffers for per-data string data transfer from the pixel memory, the two buffers are alternatingly written with data and read out. The aforementioned circuit arrangement, however, is not suitable for a controller for a thermotransfer printing device. In order to achieve a FRANKIT-compatible franking machine with thermotransfer printing, the print data controller that relieves the processing burden on the microprocessor would have to be modified. For faster printing at high print resolution, however, additional encoded pixel data would still have to be stored in columns in the pixel memory and transferred in succession into a printer controller for all phases preceding the print phase, whereby virtual columns are temporally situated between the print columns and contain encoded pixel data which serve for pre-heating of the heating elements. For example, if pixel data were stored and transferred as valid voltage values per pulse duration, a significant storage requirement would result in the machine as well as a correspondingly high time requirement for the transmission of such data.

SUMMARY OF THE INVENTION

An object of the present invention is to provide a method and an economical arrangement for controlling printing by a thermotransfer printing device on a moving print medium with a high throughput and with a high-resolution thermotransfer print head, wherein processing load for which the microprocessor is responsible for the control of the thermotransfer printing device is relieved.

Despite a higher print resolution and higher transport speed of the moving postal good, no excess load for the microprocessor should occur due to accessing the stored data. The number of the variable image elements should be nearly unlimited so that the variable print image portion can be extensive and flexible for different postal requirements. Nevertheless, the arrangement for control of the printing of a thermotransfer printing device should require optimally little memory.

The inventive method for controlling the printing by a thermotransfer printing device uses the maximum print pulse duration for printing a single dot given a constant print pulse voltage as a parameter specific for the system in use that is composed of the thermotransfer ink ribbon and the thermotransfer print head. The maximum print pulse duration can be specified by the manufacturer of the system or thermotransfer print head, or can be empirically determined by the manufacturer of the system or thermotransfer print head. The method is based on the recognition that the pre-heating temperature and printing temperature are closer to one another at higher printing speeds than at lower printing speeds. In addition to more quickly accomplishing the data processing, a particular accuracy and fineness of the control capability of the thermotransfer printing device are achieved.

In accordance with the invention, therefore, respective pixel energy values are converted by a print data controller into a number (corresponding to the pixel energy value) of binary pixel data of equal values, with each binary pixel data value (for example equal to one) being output in temporal succession during a phase (heating phase and/or printing phase) of a print pulse duration by an associated driver of the thermotransfer print head as a component of a single printing pulse that produces a printed dot situated in the print column of the print image. The print pulse duration can begin at different points in time for those heating elements with which a different pixel energy value is associated, but ends at the same point in time for all activated heating elements of the row of heating elements. Thus, no printed dots that lie in virtual columns result. The pulse duration of the single printing pulse is proportional to the aforementioned number of binary pixel data with the value equal to one.

Given a pixel energy value of zero, no pulse is generated and thus no dot is printed in the printing phase. The maximum necessary pulse duration of the activation of a heating element for printing of an image point (pixel) as a print point (dot) is thereby deconstructed into a defined maximal number of M equally-large phases. A parameter that designates the subsequent phase length is defined in this manner, that describes the duration of each phase and therewith a portion of the energy quantity required for printing that is to be supplied during the phase given a constant pulse amplitude.

The energy quantity required by each individual heating element of a high-resolution thermotransfer print head in the printing of a dot lying in the print column is supplied by the print data controller. The required energy quantity is determined in a known manner before the printing dependent on whether this heating element or adjacent heating elements are activated during the current printing of a print column or were activated in the printing of a preceding print column. The required energy quantity determines the necessary pulse duration of the activation of a heating element for printing of an image point (pixel) as a print point (dot). The respectively necessary pulse duration is likewise divided by the defined phase length (duration) in order to determine a corresponding number of phases. This transformation enables coding of the pixel energy values without significant information loss. The code is a binary code, for example a quadruple binary code with 4 bits per pixel.

Furthermore, the energy quantity of all heating elements can be changed to the same degree before the printing, the change ensuing dependent on parameters such as, for example, the print head resistance, the printing speed and the print head temperature. The process of the energy value calculation is time-consuming and therefore cannot ensue during the printing. A microprocessor is programmed by software for energy value calculation and coding as well as to provide pixel energy data. The results of the energy value calculation and coding are buffered in a pixel energy memory without the necessity of generating pixel data for virtual columns. This memory content (pixel energy data) is then prepared for activation of the print head by the print data controller by decoding during the printing in order to generate binary pixel data for the virtual columns and the actual print columns. Given a constant print pulse voltage level, the print pulse duration corresponds to a pixel energy value A that can be predetermined for each pixel by an associated code (quadruple). The maximum print pulse duration can be divided into a predetermined maximum number M of phases of equal phase lengths (durations). A phase count value B is preset to a value of M−1 that corresponds to the predetermined maximum number M of phases reduced by a value of one. The phase count value B is decremented in steps by a value of one. During each phase of the number of phases that can be selected by the phase count value B, all pixel energy values A are selected in succession for printing dots of a print column and are compared with the current phase count value B. Binary pixel data with the value "one" are generated when the phase count value B is smaller than the respectively-selected pixel energy value A.

A coding of the energy values, for example in 4 bits per pixel (quadruple), as well as their storage in the pixel energy memory ensues after the energy value calculation and before the printing. The codes of the pixel energy values (quadruple) are stored as words in the pixel energy memory for a predetermined number of print columns. Beginning with the code (quadruple) belonging to the first pixel of a print column, the subsequent codes (quadruple) belonging with the respectively adjacent pixels of the print column are stored in succession. Advantageously, the microprocessor is not additionally loaded (burdened) by the need to provide coded pixel data for virtual columns in the heating phase and the memory space requirement in the pixel energy memory is much less dependent on the number of heating phases before the actual printing phase.

The invention also concerns a print data controller with pixel energy data preparation for a high-resolution thermotransfer print head, wherein at least one pixel energy data preparation unit is controlled by a special controller in order to transfer the codes for pixel energy values per word for each print column from the pixel energy memory into a buffer and in order to generate binary pixel data for virtual columns and/or for print columns, which are serially transferred to the shift register of the thermotransfer print head, and wherein the pixel energy data preparation unit outputs pixel data for all heating elements in each phase and thus provides them to the thermotransfer print head for printing of dots in a print image column.

In an embodiment of the print data controller for a thermotransfer print head with only one serial input and a number of 360 heating elements in the row, two buffers are provided in the print data controller, with one of the buffers being alternately loaded with a number of 90·16-bit data words by direct memory access (DMA) while the other buffer is read out in order to transfer the code (quadruple) of pixel energy data in succession for each heating element in the row of the 360 heating elements to a phase data preparation unit for pixel energy data in each phase.

The loading and readout of the buffers (that are preferably executed as dual port RAMs) preferably ensues via separate ports of the buffer. After the microprocessor initializes the direct memory access (DMA) and has started the printing of a print image, the alternating loading and readout of the buffer of the print data controller is initiated via an encoder signal e. The encoder supplies a signal e with a pulse rate corresponding to the transport speed of the franking good.

The codes (quadruple) of pixel energy data for a complete print column are loaded via DMA into the print data controller for printing and buffered there. The at least one pixel energy data preparation unit for the print head activation has an output that is connected with the serial data input of the shift register of the thermotransfer print head.

The pixel energy data thus are stored in the pixel energy memory such that the direct memory access can execute a specific number of cycles in synch with the encoder clock pulse in order to load the pixel energy data for the next print column into the corresponding buffer. For printing a print column, in each phase the codes (quadruple) of pixel energy data of the same print column are sequentially read out from the respective other of the two buffers. The same codes (quadruple) of pixel energy data are thus read out for the successive phases. A column counter is incremented in the print data controller with each encoder clock pulse. When a predetermined value is reached, the printing is ended.

The codes (quadruples) of pixel energy data read out from one of the two buffers arrives at a first parallel data input (4-bit) of the at least one phase data preparation unit for pixel energy data. The pixel energy data read out from the respective other of the two buffers arrives as code (quadruples) at a second parallel data input (4-bit) of the at least one phase data preparation unit for pixel energy data. The phase data preparation unit comprises a multiplexer connected with both parallel data inputs, the parallel data output (4-bit) of which multiplexer is connected with a first parallel data input (4-bit) of an evaluator logic.

The multiplexer is controlled by a switching signal which is output by the printer controller.

A value B of a phase counter arrives at a second parallel data input (4-bit) of the evaluator logic of the at least one phase data preparation unit for pixel energy data. The parallel data output (4-bit) of the multiplexer supplies the value A. In the value range of "zero" to the value A equal to the maximum number M of equally large phases, the output of the evaluator logic only supplies a level with the logical value "1" when the value A is larger than the value B. Given the occurrence of a shift clock pulse, the respective value at the output of the evaluator logic is assumed in the shift register of the thermotransfer print head. When the output of the evaluator logic supplies a logical value of "0", no associated heating element is activated.

In another second variant, the thermotransfer print head has two serial inputs for separate shift registers. In the associated print data controller, two pixel energy data preparation units for the print head activation are provided which each comprise two buffers. In contrast to the previously-described embodiment, the 180 codes (quadruples) of pixel energy data of one half of the print column are alternately loaded into the first buffer of both pixel energy data preparation units and read out from the second buffers of both pixel energy data preparation units for the print head activation.

The output signals (SERIAL_DAT_OUT1, SERIAL_DAT_OUT2) of both pixel data preparation units for pixel energy data are shifted into the two shift registers of the thermotransfer print head for each phase and, for activation of the heating elements, are adopted into its driver registers. The phase counter is accordingly decremented. When one of the outputs is logically "1", the associated heating element is activated in the subsequent phase. When it is logically "0", it is not activated. A number of print pulses of different lengths can thus be generated for each individual heating element in the printing a column.

After all print data (360 pixels) for a first phase of a print column have been shifted to and stored in the shift register with the LH edge of the shift clock pulse, these data are transferred in parallel into a latch unit via a LATCH signal pulse and adopted in the print head driver register. The STROBEx signals are subsequently activated and the print head drivers can activate the heating elements. Due to the STROBEx signals, the activation of the heating elements then remains unblocked until the end of the last phase. During the printing, in each phase the print data for the next phase are already shifted into the print head and adopted via a LATCH signal pulse at the beginning of the next phase. The following advantages result for the microprocessor and the print data controller from this division of labor:

The codes (quadruples) can be calculated in a relatively simple manner by the microprocessor. They also required less storage space than if the complete print data for each phase were stored in the pixel memory.

As a result of this solution, pixel energy data can exist stored as code (quadruples) in the pixel energy memory in an optimal order that unloads the microprocessor given the print image alteration. The processing burden on the microprocessor is likewise relieved by the data transfer by DMA.

The 4-bit-encoded energy values can simply be copied in typical image formats and additionally enable a simple testing.

The bus load of the microprocessor is reduced since print data are only loaded into the buffer of the print data controller once via DMA per print column. A correspondingly-high time requirement for the transmission of such data for heating phases is done away with. Less data are thus loaded into the print data controller than are shifted from the latter to the thermotransfer print head.

The microprocessor is unloaded due to the adjustable phase length since, given parameter changes (for example the temperature), only one register value of the print data controller has to be changed and not all codes (quadruples) in the pixel energy memory.

The energy quantity that is supplied to a heating element is determined by the print pulse duration. Given a more constant voltage level of the print pulse, it is activated proportional to the product of the phase number and phase duration for the heating element. The voltage feed of the print head can thus ensue via a cost-effective standard mains adaptor with a fixed output voltage of 24 V and does not have to be adjusted.

Because the STROBE signal remains active during all phases determining the print pulse duration and is not temporarily deactivated after each phase, the heating elements can be activated without interruption for printing of dots of a print column. A high print speed thus can be achieved.

DESCRIPTION OF THE PREFERRED EMBODIMENTS

Figure 1:
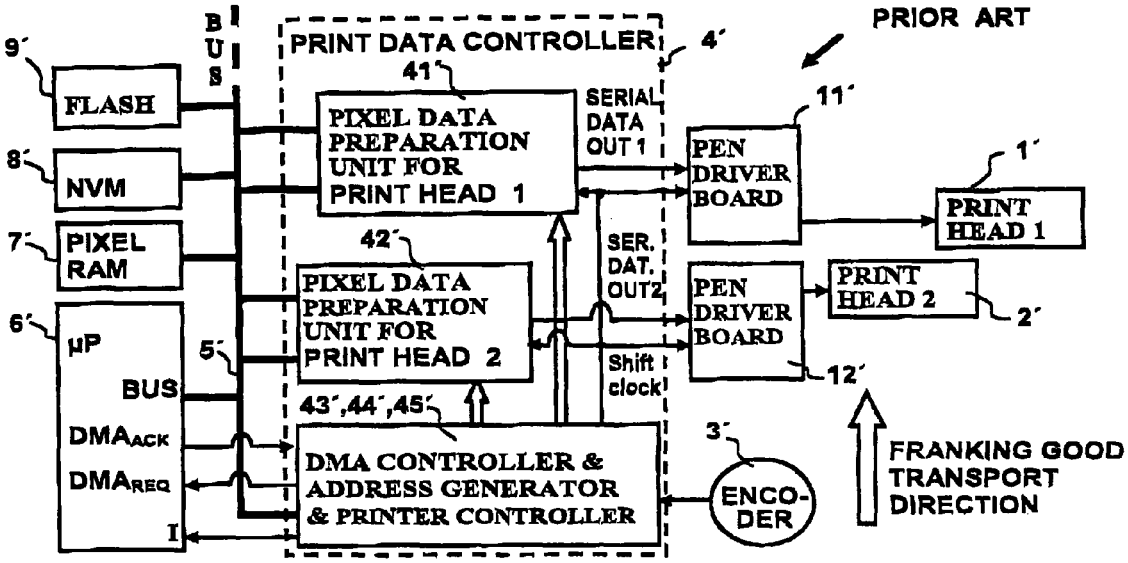
FIG. 1 is a simplified block diagram of the franking machine Ultimail®

FIG. 1 is a simplified block diagram of the franking machine Ultimail® as prior art for the print data controller of a FRANKIT-compatible franking machine. At least one microprocessor 6', one pixel memory RAM 7', one non-volatile memory NVM 8' and a read-only memory FLASH 9' are connected in terms of addressing, data and control with a print data controller 4' via a bus 5'. Moreover, a postal security module (PSD) is used (in a manner not shown) to support the microprocessor of the main board.

The print data controller is composed of a pixel data preparation unit 41', 42' and a special controller. The latter includes a DMA controller 43', an address generator 44' and a printer controller 45' on which an encoder 3' is connected that detects the print medium transport movement. The DMA controller 43' allows an access to the binary pixel data stored in the pixel memory 7' in order to make the latter available in data strings to the pixel data preparation unit 41', 42'. The address generator 44' generates addresses that are supplied to the pixel data preparation unit 41', 42' from a buffered data string and grouping in the required order for selection of the binary pixel data. The printer controller 45' controls the pixel data preparation unit 41', 42' in order to supply the binary pixel data in groups to a driver unit 11', 12' of the inkjet print head 1', 2'. For this, a shift clock signal (shift clock) is emitted by the printer controller 45' both to the pixel data preparation units 41', 42' and to the driver units (pen driver boards) 11', 12' which activate the inkjet print heads 1', 2'.

Figure 2:
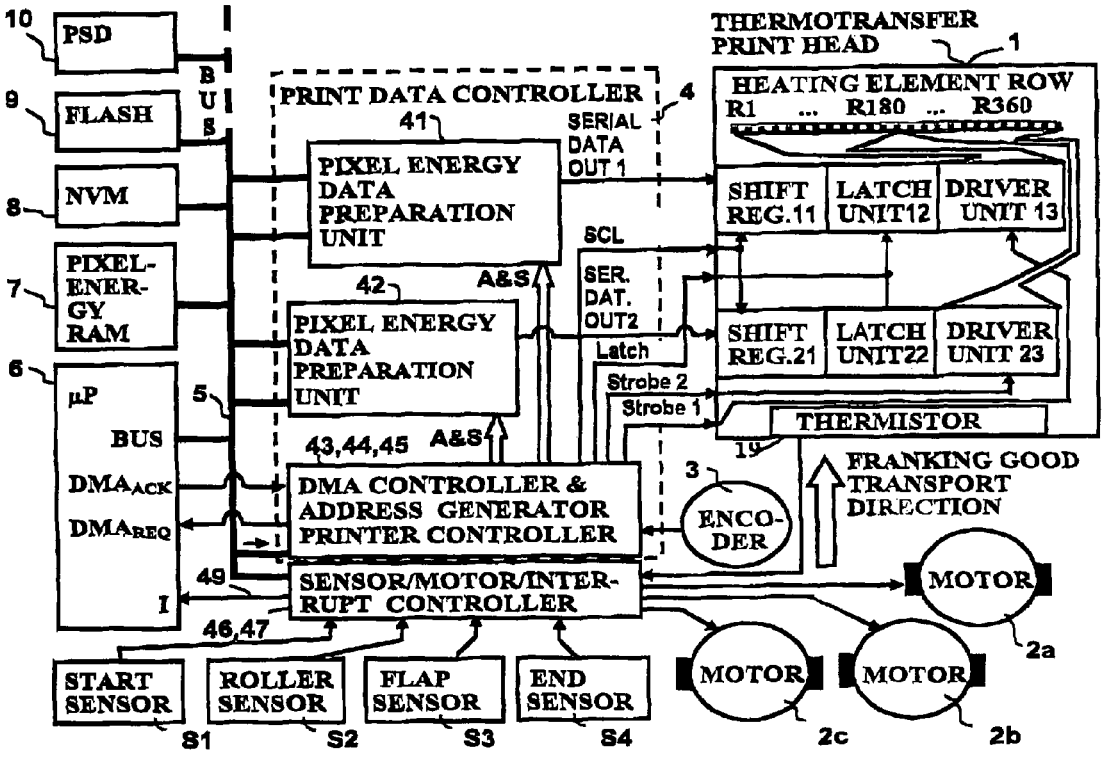
FIG. 2 is a block diagram for controlling printing by a franking machine with a print data controller for a thermotransfer print head in accordance with the invention.

FIG. 2 shows a block diagram for control of the printing of a franking machine with a print data controller for a thermotransfer print head in accordance with the invention. At least one microprocessor 6, a pixel energy memory RAM 7, a non-volatile memory NVM 8, a read-only memory FLASH 9 and a postal security module (PSD) 10 are connected in terms of addressing, data and control with the print data controller 4 via a bus 5. The thermotransfer print head 1 is connected with the print data controller 4 which, given a direct memory access, takes in present 16-bit parallel data from bus 5 on the input side and outputs serial binary pixel data in columns to the thermotransfer print head 1 on the output side. An encoder 3 is connected with the print data controller 4 in order to initiate the buffering of the pixel energy data and the printing of the dots of the print columns, whereby each thermotransfer print head is operated with a shift clock frequency of approximately 2.5 MHz. The approximately 30 mm-wide thermotransfer print head 1 is designed for high-resolution and has internal activation electronics and a number of 360 heating elements that are arranged in a row. A first portion composed of 180 heating elements is activated in parallel by a first shift register 11 via a first latch unit 12 and first driver unit 13. A second portion composed of 180 heating elements is activated in parallel by a second shift register 21 via a second latch unit 22 and second driver unit 23. The print data controller 4 therefore has separate outputs respectively for first and second pixel energy data preparation units 41 and 42 as well as associated controllers 43, 44 and 45. The associated controllers 43, 44 and 45 are connected with the pixel energy data preparation units 41 and 42 via address and control lines A and S. A printer controller 45 is connected in terms of control with a DMA controller 43, with the thermotransfer print head 1 and with an address generator 44 as well as that the latter is connected in terms of control with the pixel energy data preparation unit 41, 42. The printer controller 45 is directly connected with the microprocessor 6 via the bus 5. The DMA controller 43 is connected with the microprocessor 6 via a control line for DMA control signals $DMA_{ACK}$, $DMA_{REQ}$. The printer controller 45 is connected in terms of control with the sensor/motor controller 46 and an interrupt controller 47. A start sensor S1, a roller sensor S2, a flap sensor S3, an end sensor S4 and a thermistor 19 are connected with the sensor motor controller 46. A motor 2*a* to drive a roller (not shown) for winding the used thermotransfer ink ribbon, a motor 2*b* to drive a counter-pressure roller for print medium transport during the printing, and a motor 2*c* to operate the pressure mechanism of the counter-pressure roller in order to press the print medium on the thermotransfer print head 1 by means of the counter-pressure roller, are connected with the sensor/motor controller 46. The interrupt controller 47 is directly connected with the microprocessor 6 via a control line 49 for an interrupt signal 1.

Figure 3:
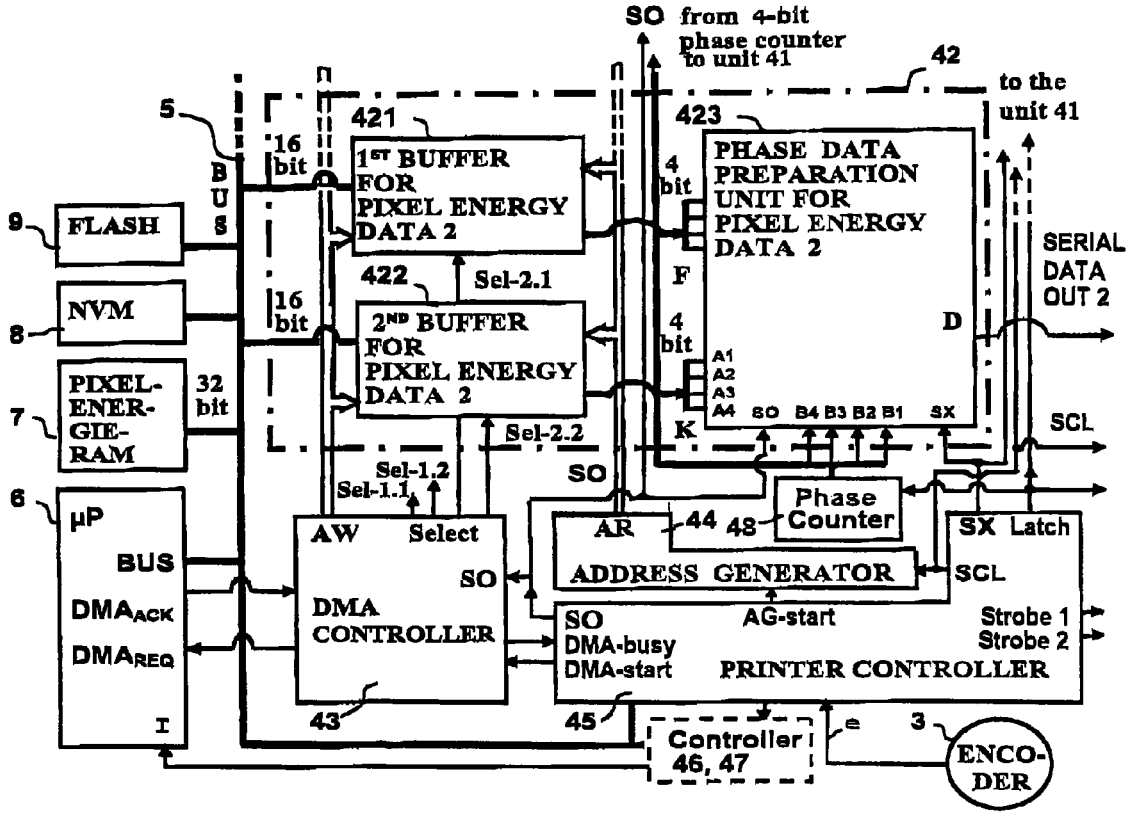
FIG. 3 is a detail of the block diagram according to FIG. 2 for a circuit arrangement for controlling a pixel energy data preparation unit.

FIG. 3 shows a detail of the block diagram of FIG. 2, with a circuit arrangement for controlling a pixel energy data preparation unit. At least the microprocessor 6, the pixel energy memory 7, the non-volatile memory 8 and the read-only memory (FLASH) 9 are connected in terms of addressing, data and control via the bus 5. The printer controller 45 is also connected with the microprocessor 6 via the bus 5. The sensor/motor controller 46 and interrupt controller 47 additionally connected with the printer control 45 were not shown in detail in FIG. 3 for simplification, but were only shown dashed. The encoder 3 is connected with the printer controller 45 to emit an encoder signal e. Like the pixel energy data preparation unit 41 (not shown), the shown pixel energy data preparation unit 42 is connected (in the subsequently-described manner) with the thermotransfer print head 1, with a DMA controller 43 for a direct memory access (DMA) as well as with the circuits (arranged in a circuit block) of an address generator 44, a printer controller 45 and a phase counter 48. The pixel energy data preparation units 41 and 42 are identically designed and are composed of two buffers 411, 412 or 421, 422, and a phase data preparation unit 413, or 423. The switching signal SO and the control signal SX are generated by the printer controller 45 and are connected via control lines with the phase data preparation unit 413 (not shown) and with the shown phase data preparation unit 423. The switching signal SO is moreover supplied via a control line to the DMA controller 43. The latter is also connected with the printer controller 45 via control lines for DMA control signals (DMA-Start and DMA-busy), whereby the DMA controller 43 is supplied by the printer controller 45, and the DMA controller 43 emits the DMA-busy signal with the value "zero" to the printer controller 45 in order to signal that the direct memory access is occurring and the DMA cycles are ended. The DMA controller 43 generates address write signals AW as well as selection signals Select-2.1 and Select-2.2 for the shown buffers 421 and 422 of the second pixel energy data preparation unit 42 as well as Select-1.1 and Select-1.2 for the buffers 411 and 412 (not shown) of the first pixel energy data preparation unit 41 for alternating storage and readout of all quadruples of a print column. The quadruples are binary-encoded pixel energy data of 4 bits each and are provided in print columns in the pixel energy memory 7. 360·4 bits=1440 bits are stored in 90·16-bit data words for each print column. Although the microprocessor 6 has a 32 bit-wide data bus, a 16-bit memory is used to reduce the manufacturing costs. An internal DMA controller of the microprocessor 6 also allows addressing of 16 bit-wide data words. The buffers 411, 412 and 421, 422 are connected to the data bus. Buffering of a print column given direct memory access (DMA) consequently requires a buffering of 45*16-bit data words in succession in two buffers, with the buffers being selected by the selection signals. In the following exemplary embodiments, "data word" and "per word", mean a 16 bit-wide data word if the data word width is not expressly additionally specified.

The DMA controller 43 generates and emits selection signals Sel_1.1, Sel_1.2 or Sel_2.1, Sel_2.2 dependent on the switching state of the switching signal SO in order to buffer the quadruples in the respective first or respective second of the two buffers 411, 421 and 412, 422. Given a transfer of 180 quadruples from one of the two buffers to the respective phase data preparation units 413 and 423, the other buffers are likewise respectively selected in succession by the selection signals for buffering of the quadruples of a subsequent print column.

A 6 bit-wide address write signal AW is supplied by the DMA controller 43 for per-word addressing. The address write signal AW is present at a separate address input of each of the first and second buffer 421 and 422. A first selection signal Sel_2.1 for pixel energy data for the second print column half is supplied by the DMA controller 43 and is present at a separate control input of the first buffer 421 for pixel data for the second print head. A second selection signal Sel_2.2 for pixel energy data for the second print column half is supplied by the DMA controller 43 and is present at a separate control input of the second buffer 422 for pixel energy data for the second print column half.

The printer controller 45 evaluates the address and control signals transmitted via the bus 5. The address and control signals are evaluated with regard to the occurrence of a printing error. The printer controller 45 is connected with the DMA controller 43 via at least one control line.

Initiated by a print command, a first control signal DMA-start is output to the DMA controller 43 by the printer controller 45. A request signal $DMA_{REQ}$ is thereupon generated by the DMA controller 43 and sent to the microprocessor 6. The microprocessor has an internal DMA controller (not shown) that, given a direct memory access, places a specific address in the pixel energy memory (RAM) 7, whereby a per-word transmission of quadruples of the pixel energy data to the buffer via bus 5 is enabled. For this purpose, an address write signal AW is supplied to the buffer by the DMA controller 43. For example, by DMA the microprocessor 6 can read a 16 bit-wide data word with pixel data out from the pixel energy memory RAM 7 and transmit it to the print data control unit. The microprocessor 6 sends an acknowledgement signal $DMA_{ACK}$ to the DMA controller 43 in order to synchronize the generation of the address write signal AW in the DMA controller 43 with the DMA cycle of the microprocessor 6. A 16 bit-wide data word with 4 quadruples of pixel energy data arrives in each buffer per DMA cycle. Each of the four buffers can in total provide 180·4 bits for further data preparation after 45 DMA cycles. To achieve a print resolution of 360 dpi, two of the four buffers are used for writing during the DMA cycles. Switching means for output of the second control signal DMA-busy and for realization of at least one cycle counter for a predetermined number of 16-bit data words are provided in the DMA controller 43, whereby the cycle counter is started by a DMA-start signal.

Given per-word writing and readout of pixel energy data for the first or, respectively, second print column halve, both buffers 411 and 412, or 421 and 422, alternate. The process in the DMA controller 43 is explained in more detail below using FIG. 8.

A shift clock signal SCL of the printer controller 45 is connected with the thermotransfer print head 1 and the address generator 44 via a control line. The address generator 44 generates and emits address read signals AR. The printer controller 45 emits an address generator start signal AG-start to the address generator 44 that is charged with the shift clock signal SCL of the printer controller 45 in order to generate read addresses AR, which enable a readout of the quadruples from those buffers in which no quadruples are loaded and buffered at the moment.

Alternatively, the address generator 44 can be supplied with a different control signal than the shift clock signal SCL of the printer controller 45 in order to generate read addresses AR. For example, a clock signal with a frequency of approximately 20 MHz can be generated internally or by an external oscillator, with a left edge of the internal clock signal, which immediately follows the LH edge of the shift clock signal SCL, being used for timing the address generator 44.

Further control lines are provided by the printer controller 45 for control signals Latch and Strobe1 as well as Strobe2 and connected with the corresponding control inputs of the thermotransfer print head 1.

Like the shown second phase data preparation unit 423, a first phase data preparation unit 413 (not shown) has two parallel data inputs F, K of 4 bits that are connected with the outputs of both buffers in order to provide a binary-coded value A=A4, A3, A2, A1. Both phase data preparation units 413, 423 moreover comprise a second parallel data input of 4 bits for a binary-encoded value B=B4, B3, B2, B1 and a serial 1-bit data output D. The following apply:

$$A=A4\cdot 2^3+A3\cdot 2^2+A2\cdot 2^1+A1\cdot 2^0$$

and $B=B4\cdot 2^3+B3\cdot 2^2+B2\cdot 2^1+B1\cdot 2^0$.

The latch control signal if the printer controller 45 is connected with a counter input of the phase counter 48. The phase counter 48 places the binary-encoded value B=B4, B3, B2, B1 at the second 4-bit parallel data input of the phase data preparation units for pixel energy data.

The functioning of the phase data preparation units is explained in more detail below using FIGS. 4, 5*a* and 5*b*.

Figure 4:
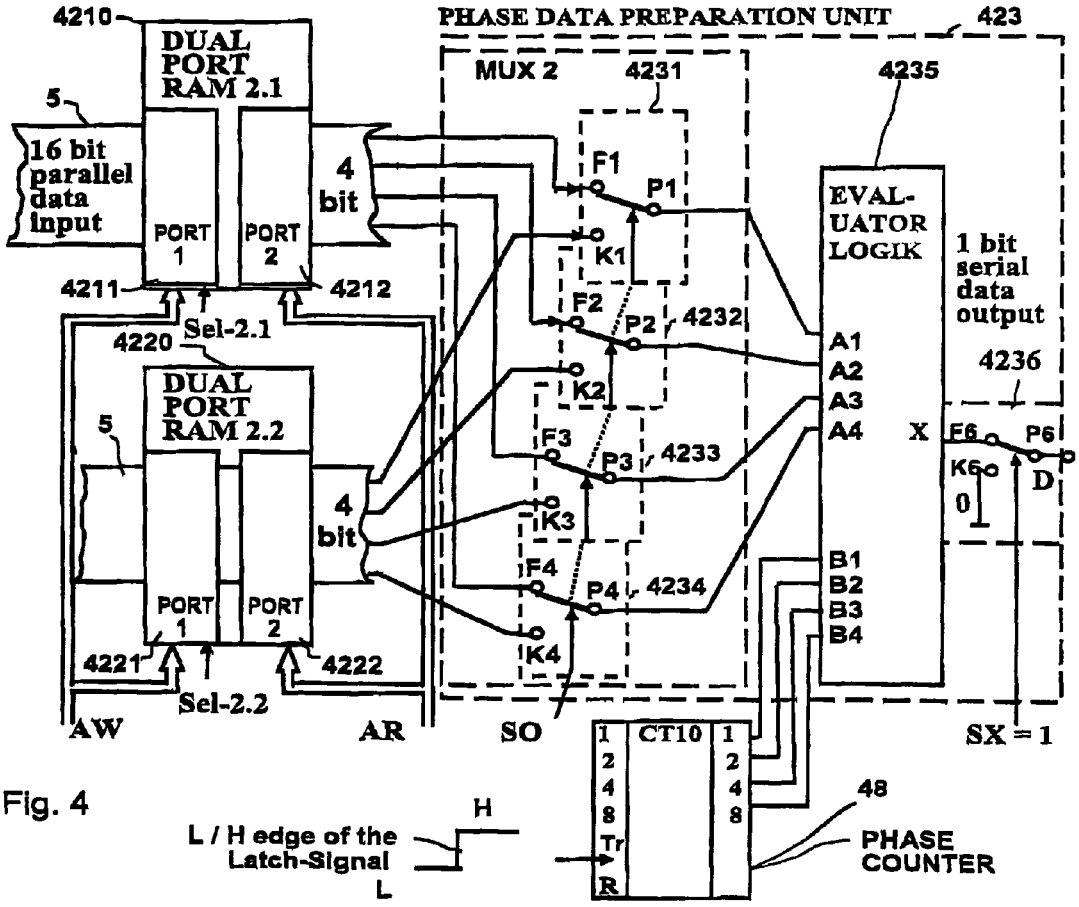
FIG. 4 is a detail of the circuit arrangement according to FIG. 3 for a circuit arrangement of the pixel energy data preparation unit.

A detail of the circuit arrangement of FIG. 3 is shown in FIG. 4 with a circuit arrangement of the pixel energy data preparation unit. The first and second buffers 421 and 422 for pixel energy data for the second print column half are realized, for example, as dual port RAM 4210 and 4220. The latter are selected for the import of the pixel energy data, due to, either the first or second selection signal Sel_2.1 or Sel_2.2 supplied by the DMA controller being present at a separate control input of the first port 4211, of the first dual port RAM 4210, or the first port 4221 of the second dual port 4220. First and second selection signals Sel_2.1 or Sel_2.2 are alternatingly supplied by the DMA controller 43 during the DMA cycles for per-word writing of pixel energy data for the second print column half. An address write signal AW is present at the respective first port 4211 or 4221 given import of pixel energy data. The desired pixel count for each print image column in total requires 90 data words of 16 bits to be buffered in two of four buffers.

In the same manner (but not shown in detail), the pixel energy data for the first print column half are supplied via bus 5 and are present at a corresponding data input of the first and second buffer 411 and 412 for pixel data that are printed in the first print column half. The first pixel energy data preparation unit 41 (not shown in detail in FIG. 2) likewise has first and second buffers 411 and 412 which are respectively connected on the input side to the low-order 16-bit of the data bus of the bus 5. The address write signal AW supplied by the DMA controller 43 is likewise present at separate address inputs of each of the first and second buffers 411 and 412 for pixel energy data that are provided for the first print column half. A first selection signal Sel_1.1 for pixel energy data for the first print column half is supplied by the DMA controller 43 and is present at a separate control input of the first buffer 411 for pixel energy data for the first print column half. A second selection signal Sel_1.2 for pixel energy data for the first print column half is supplied by the DMA controller 43 for a subsequent print column and is present at a separate control input of the second buffer 412 for pixel energy data that are provided for the first print column half of the subsequently print column. For example, the previously imported pixel energy data are subsequently read out from the first or second dual port RAM 4210 or 4220. For this purpose, an address read signal AR, which is supplied by the address generator 44, is applied at the second port 4212 or 4222. The manner by which the read pixel energy data are further processed is described in the following.

The first pixel energy data preparation unit 41 (not shown in detail in FIG. 2) for pixel energy data of the first print column half is designed identically the second pixel energy data preparation unit 42 (shown in FIG. 4) for pixel energy data of the second print column half.

The address read signal AR supplied by the address generator 44 is likewise again applied at a separate address input of the first and second buffer 421 and 422 of the second pixel energy data preparation unit 42 for pixel energy data of the second print column half. The parallel data outputs of the first and second buffer 421 and 422 for pixel energy data are respectively present at first and second inputs of a second phase data preparation unit 423 for pixel energy data.

Each half of the print image is printed by half of a heating element row of the print head. The internal print head electronics for each half of the heating element is designed in a similar manner.

Since the printer controller 45 contains means for generating and emitting the switching signal SO which activates the phase date preparation unit 423, the pixel energy data can be selected from respective outputs of the first or second of the two buffers 421 and 422 for further data processing. The phase data preparation unit 423 has four change-over switches 4231, 4232, 4233 and 4234 at the input side for the parallel data inputs as well as an evaluator logic 4235 with an output-side change-over switch 4236. The printer controller 45 controls the four input-side change-over switches 4231, 4232, 423 and 4234 via the switching signal SO and the output side change-over switch 4236 via the control signal SX. The switching by the change-over switch 4231 ensues between the terminals H1 and K1 on an output P1. The remaining change-over switches 4232, 4233 and 4234 as well as 4236 are preferably designed in the same manner. The change-over switches can be realized, for example, by logic gates. Alternatively, a 4-bit multiplexer Mux 2 is used for the input-side change-over switch and is controlled by the switching signal SO which is output by the printer controller 45 and is likewise present at a control input of the DMA controller (FIG. 3).

The phase counter 48 is indexed by the LH edge of the Latch signal and is preferably designed as a backwards counter and is preset to a count value. The parallel output of the phase counter 48 that supplies the binary value B and the parallel output of the 4-bit multiplexer Mux 2 (or, alternatively: the outputs of the input-side change-over switches or gates) supplying the binary value A are connected with both parallel data inputs of the evaluator logic 4235. The serial output X of the evaluator logic 4235 is connected with the first input F6 and a (ground) potential with the value "zero" is connected with the second input K6 of the output-side change-over switch 4236. The change-over switch 4236 emits the binary value D="1" at its output P6 when a pulse should be pushed and the control signal SX="1". After the initialization of the FPGA and given the first direct memory access DMA, no further pulse should be pushed and the control signal is consequently SX="0".

The process controller of the printer controller is subsequently explained in more detail using FIG. 6.

The entire print data controller preferably is realized with an application-specific integrated circuit (ASIC) or as programmable logic such as, for example, a Spartan-II 2.5V FPGA available from the company XILINX (www.xilinx.com).

Figure 5A:
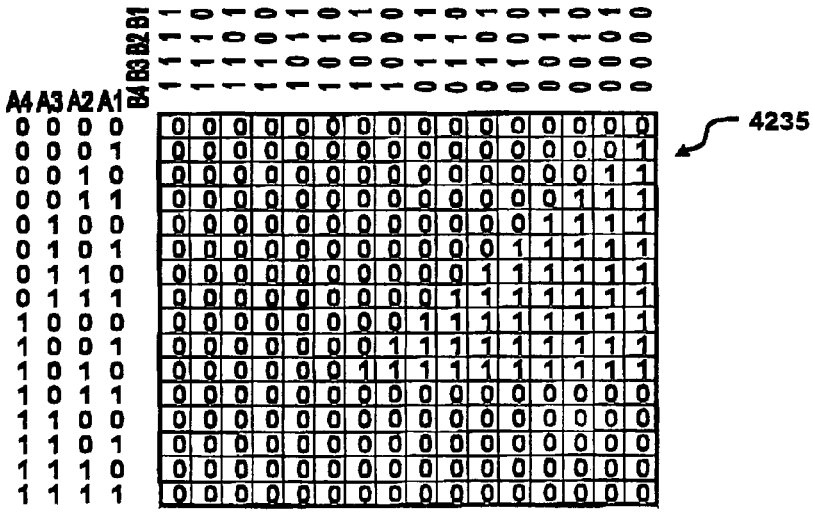
FIG. 5*a* is a logic table for evaluator logic in accordance with the present invention.
Figure 5B:
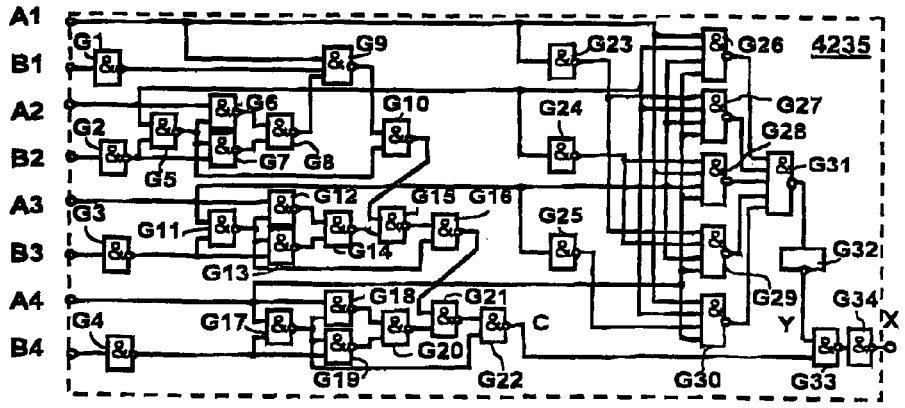
FIG. 5*b* is a circuit arrangement for the evaluator logic.

FIG. 5*a* shows the logic table of the evaluator logic 4235. The quadruples for values A of the pixel energy data have been represented as lines and the values B of the phase counter have been represented as columns of the table in which the association of a binary value that is output at the output X of the evaluator logic 4235 is to be obtained. The binary value "1" characterizes a pulse during a phase. The contribution of successive phases to the pulse duration for the activation of the heating elements is therewith also to be learned from the table in FIG. 5*a*. The data of the table are preferably stored in a memory formed in the FPGA. For example, such an association (apparent from the table) of the quadruples for values A of the pixel energy data and the values B of the phase counter with a value X output by an evaluator logic can be realized with a (programmable) read-only memory. For example, the maximum number M of phases of equal size is defined as M=10 in the table. The value X=0 is then output from the table for the value A=0 and for all values A of the pixel energy greater than M. The value X=0 is also output from the table for all count values B of the backwards counter that are greater than or equal to the value A of the pixel energy; however, the value X=1 is output for all count values B of the backwards counter that are smaller than the value A of the pixel energy. Consequently follows that:

Given A>B, C=1 and given A≦M, Y=1, given A≦B, C=0 and given A>M, Y=0 as well as $C \cdot Y = X$.

Alternatively, a logic arrangement designed from logical gates can be used that fulfills the aforementioned conditions. FIG. 5*b* shows a circuit arrangement of the evaluator logic 4235 that is designed from logical NAND gates. The binary-encoded values B4, B3, B2, B1 are logically negated by the gates G1 through G4, which is subsequently designated by N( ) or N[ ]. The respective downstream gates G9, G5, G11 and G17 link the logically-negated values N(B4), N(B3), N(B2), N(B1) with the values A4, A3, A2, A1 according to a logical function N[Ai·N(Bj)] with i=1, 2, 3, 4 and j=1, 2, 3, 4. A value "0" results at the output of the gates G9, G5, G11 and G17 for all values Ai>Bj. A value "1" results at the output of the gates G9, G5, G11 and G17 for all values Ai<Bj. The gates G5, G6, G7 and G8, the gates G11, G12, G13 and G14 as well as the gates G17, G18, G19 and G20 are connected as exclusive-or and consequently have the function Ai XOR N(Bj) for values Ai and N(Bj) given i=j>2. A value "1" results at the output of the gate G20 or G14 for A4=B4 or A3=B3. The circuits for the evaluation of the values A3, B3 and A4, B4 respectively form an identically-designed stage (level), and the circuit arrangement of the evaluator logic 4235 can in principle be expanded by such stages.

A value "1" likewise results at the output of the gate G9 for A1=B1. The gate G9 has a double function and, with the downstream gate G10, forms a combination gate controlled by the gate G8, which combination gate is open for values A2=B2 and applies the output-side value of the gate G9 at an input of the gate G10. The gates G15 and G21 have such a double function. Due to the value "0" provided by the output of the gate G20, the combination gate formed downstream of the gate G21 is closed given A4<B4. The output C of the gate G22 produces the value "0" because the aforementioned condition A>B for the output of a value X=1 is not provided. A value X=1 however, is required to form the pulse necessary for the activation of the heating elements. For A4=B4, a value "1" results at the output of the gate G20 and the combination gate controlled by gate 20 and formed by the gates G21 and G22 is open for the transfer (carry-over) from the previous stage that is provided at the output of the gate 16. The value at the output X is dependent on the value of the transfer to the output C. Thus:

$$C \cdot Y = X$$

The circuit part with the gates G1 through G21 outputs the value C=1 for all count values B of the backwards counter that are smaller than the value A of the pixel energy.

The circuit part with the gates G23 through G32 outputs the value X=0 at the output Y for all values A of the pixel energy that are greater than or equal to M. Given the use of a 16-bit backwards counter as a phase counter 28, the value A=11 is determined from the values A4, A3, A2, A1 by means of the gate G30, the value A=12 is determined from the values A4, A3, A2, A1 by means of the gate G29, the value A=13 is determined from the values A4, A3, A2, A1 by means of the gate G28, the value A=14 is determined from the values A4, A3, A2, A1 by means of the gate G27 and the value A=15 is determined from the values A4, A3, A2, A1 by means of the gate G26, in that the respective NAND gate output assumes the value=0. The interconnection of the NAND gates 26 through 31 logically forms an OR element which assumes the value=1 at the output when the condition exists that the energy values A≧M=10 have been transferred. A NOR function and therewith the value Y=0 is achieved by means of the gate G32 via negation of the output value of the gate G31. Thus:

$$Y = Q26 \cdot Q27 \cdot Q28 \cdot Q29 \cdot Q30$$

with $Q26 = N[A4 \cdot A3 \cdot A2 \cdot A1]$ at the output of the gate G26, $Q27 = N[A4 \cdot A3 \cdot A2 \cdot N(A1)]$ at the output of the gate G27, $Q28 = N[A4 \cdot A3 \cdot N(A2) \cdot A1]$ at the output of the gate G28, $Q29 = N[A4 \cdot N(A3) \cdot N(A2) \cdot A1]$ at the output of the gate G29, $Q30 = N[A4 \cdot N(A3) \cdot A2 \cdot A1]$ at the output of the gate G30, The function Y in principle can be expanded with further gates for a further digit of the binary-encoded number for pixel energy data. The shown design by means of NAND gates serves only as an exemplary embodiment and does not exclude a design with NOR gates or other logical gates.

Figure 6:
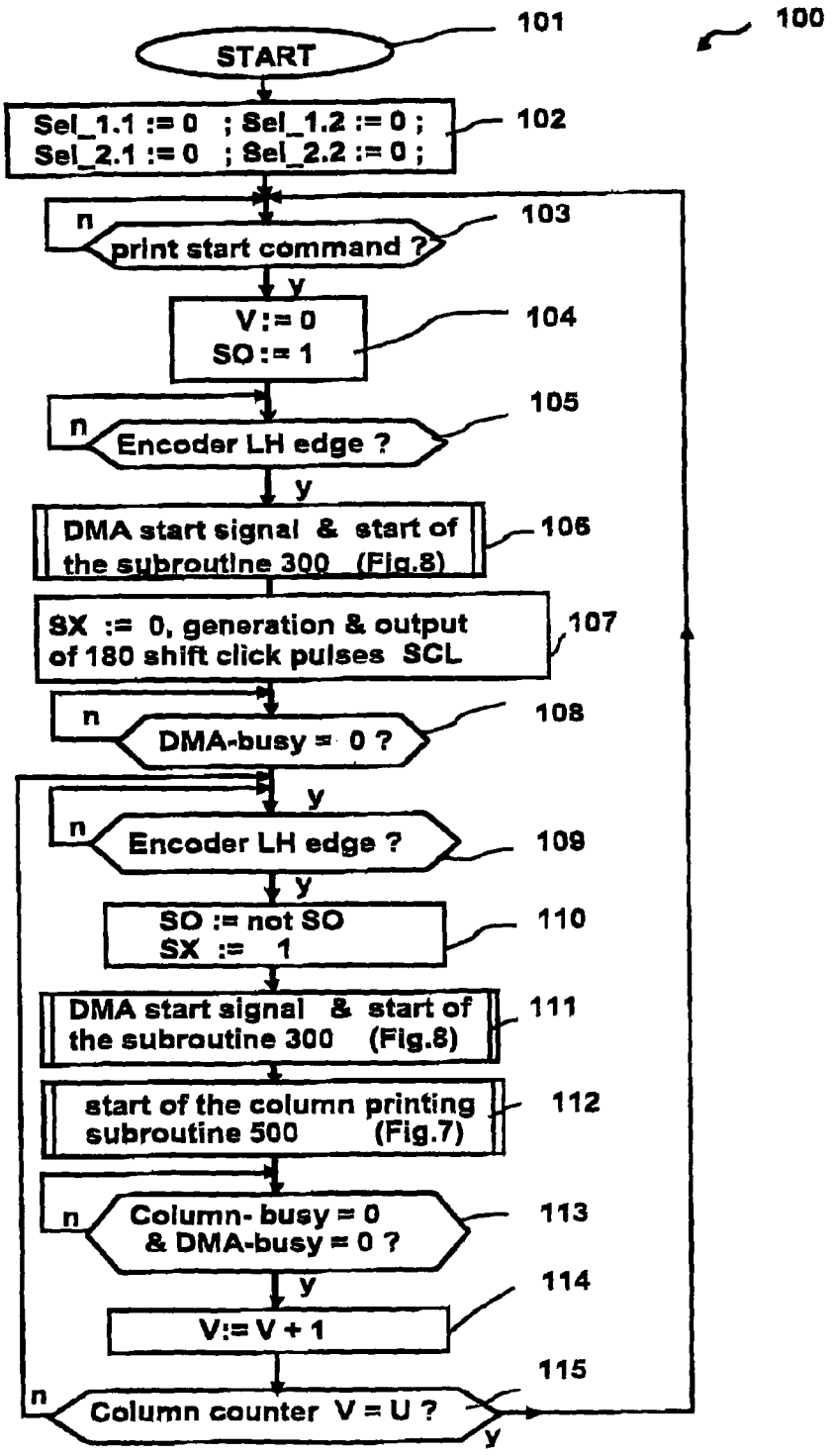
FIG. 6 is a flowchart for the printer controller in accordance with the invention.

FIG. 6 shows a flowchart for the process control of the printer controller. After the activation and start in the step 101, a step 102 is achieved and all selection signals Sel_1.1, Sel_1.2, Sel_2.1, Sel_2.2 are set to the value "zero" in the routine 100 of the process control. In a first query step 103, a data word transmitted via the bus is now evaluated with regard to the occurrence of a command for printing start. If this has not yet been issued, the process then branches into a wait loop. Otherwise a setting of the column count value V to the value "zero" occurs in a step 104 after the printing start. The switching signal SO is set to the value "one" and output. In a second query step 105, the encoder signal e is not evaluated with regard to the occurrence of an LH edge. If this has not yet occurred, the process then branches into a wait loop. Otherwise a signal DMA-Start is output in a step 106 and a subroutine 300 is started which sets specific selection signals Sel_1.1, Sel_1.2, Sel_2.1 or Sel_2.2 to the value "one" in order to transfer the binary pixel energy data from RAM 7 into the buffers of the pixel data preparation units 41 and 42, which is explained in more detail below using FIG. 8.

Figure 7:
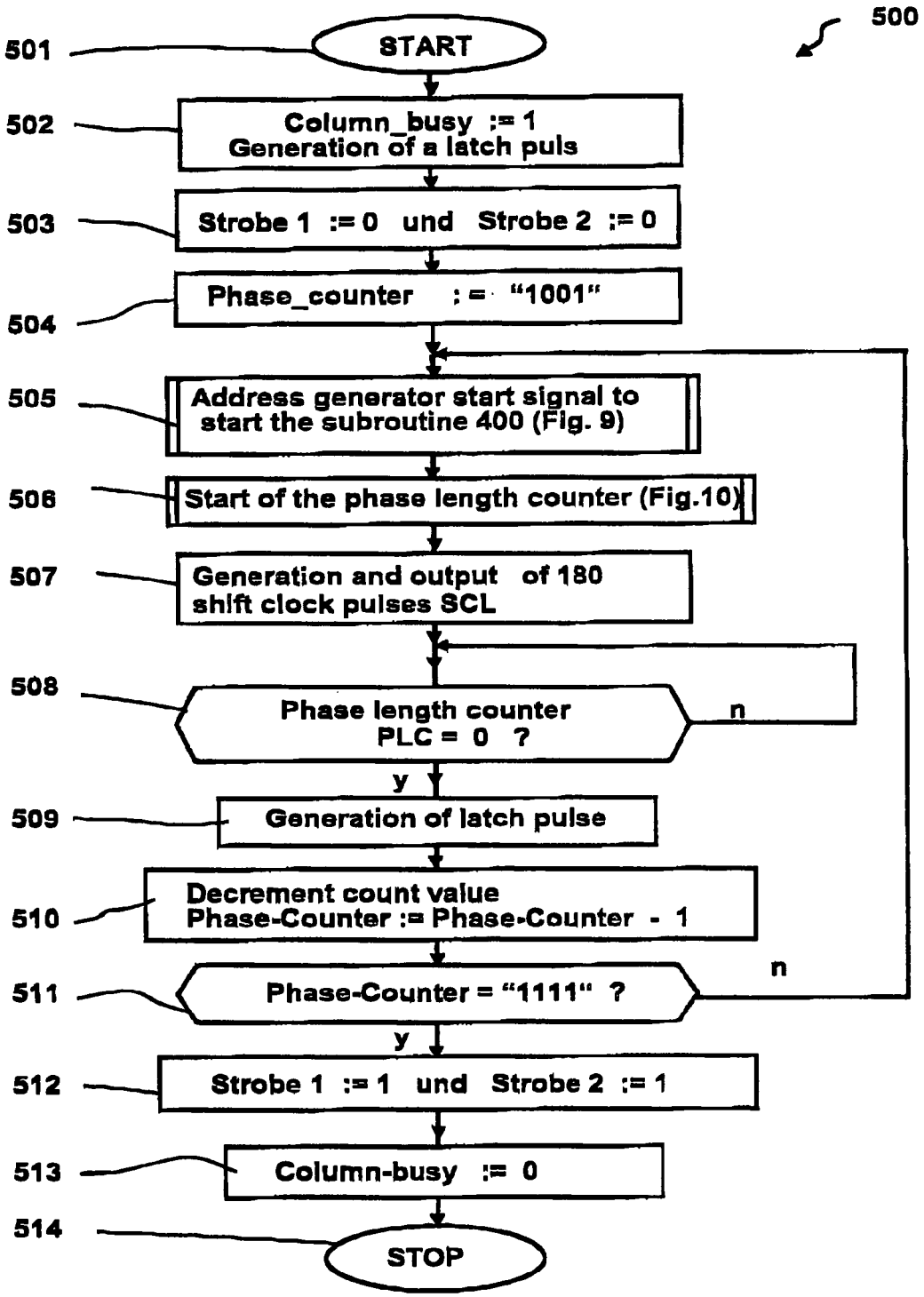
FIG. 7 is a flowchart for the printing routine for a print column in accordance with the present invention.
Figure 8:
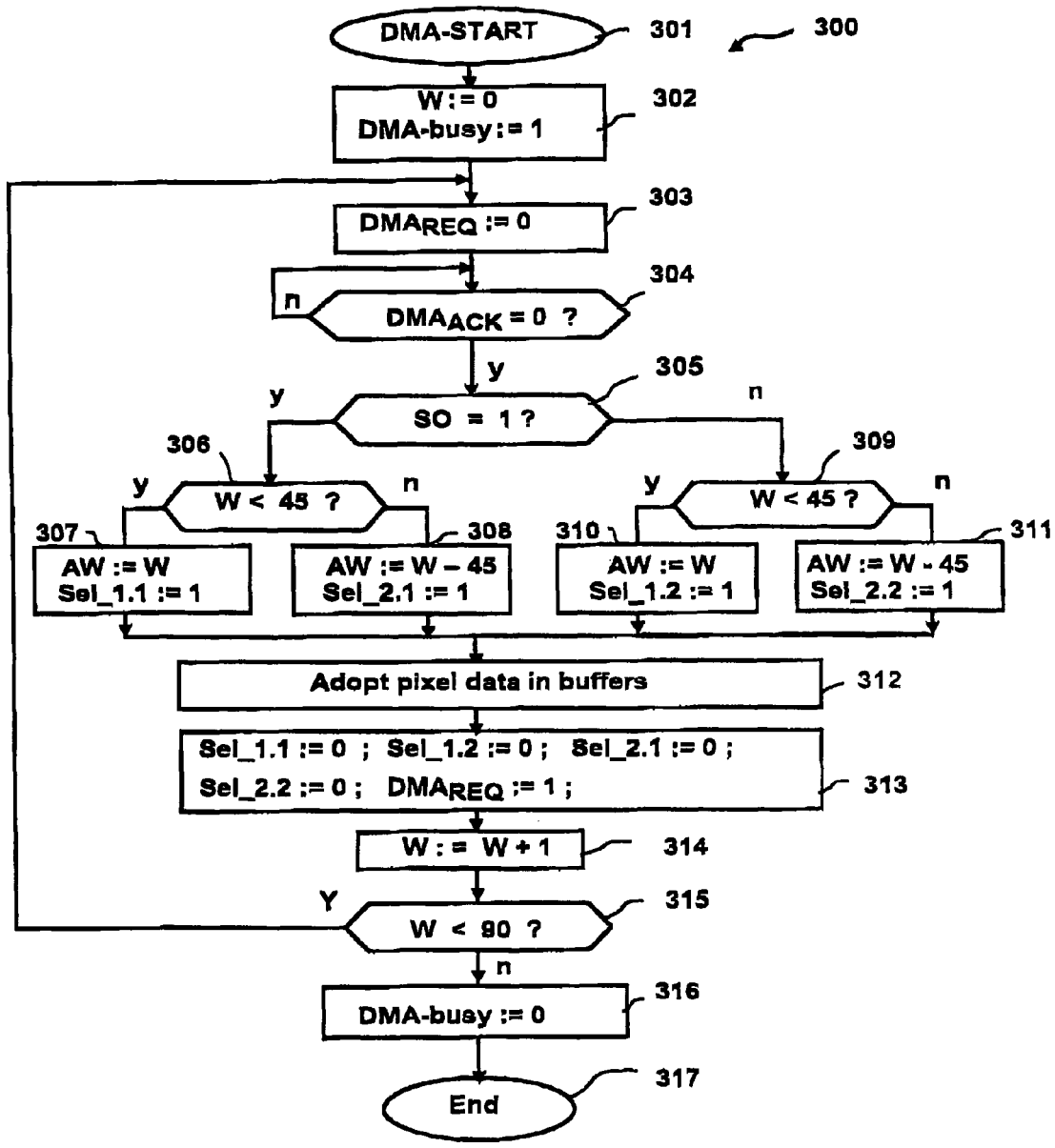
FIG. 8 is a flowchart for DMA control in accordance with the present invention.

In a step 107, a control signal SX is output by the printer controller and a subroutine is started for generation and output of 180 shift clock pulses SCL. In a third query step 108, the DMA-busy signal is now evaluated with regard to whether it has been set to the value "zero". If this is not yet the case, the process then branches into a wait loop. However, if the DMA-busy signal has been set to the value "zero", a fourth query step 109 is then reached in which the encoder signal is evaluated with regard to the occurrence of an LH edge. If this has not yet occurred, the process then branches into a wait loop. Otherwise, in a step 110 the switching signal SO is logically negated, the control signal SX:=1 is set and output. A DMA-Start signal is subsequently output in step 111 and the DMA controller is activated to restart the aforementioned subroutine 300 (FIG. 8). Further subroutines can run parallel to the subroutine 300. A column printing subroutine 500 is now started in step 112 (FIG. 7). When the column printing subroutine 500 is finished, a signal Column-busy=0 is output. In a fifth query step 113 it is queried whether a signal Column-busy=0 has been output and whether the DMA-busy signal has been set to the value "zero". If the former or the latter is not yet the case, the process then branches into a wait loop. Otherwise a step 114 is reached in which the column count value is incremented V:=V+1 given the occurrence of the LH edge of the encoder clock pulse.

In a sixth query step 115 it is evaluated whether the column count value V has reached a limit value U. When a predetermined limit value is reached, the printing of the print image (preferably a franking imprint) is ended. If this is not yet the case, the process branches to the fourth query step 109. Otherwise the process branches to the first query step 103 and the routine begins anew as soon as a print start command is established in the first query step 103.

A flowchart of the printing routine for a print column is shown in FIG. 7. This is invoked as a column printing subroutine 500 in the course of the routine 100 of the workflow controller in order to serially write all pixel data of a column into the shift register of the thermotransfer print head and to generate latch pulses.

After the start in step 501, a step 502 is reached in which a signal Column-busy:=1 is set and a latch pulse is generated. This effects a transfer of pixel data (for example initially with the value "zero" that was loaded into the respective shift register 11, 12 of the thermotransfer print head 1 given the control signal SX:=O), into the respective latch unit 12, 22 of the thermotransfer print head 1 and a provisioning for situations respective driver unit 13, 23. The printing signals Strobe1:=0 and Strobe2:=0 are then generated in step 503 and output to the driver units 13, 23.

In step 504, the phase counter 48 is subsequently preset to the value M−1, i.e. Phase_counter:="1001". In step 505, the address generator start signal AG-start is output by the printer controller 45 to start the subroutine 400. The details of the address generation are subsequently explained in detail using FIG. 9. In the next step 506, a phase length counter or a subroutine 200 for phase length generation is then started. The phase length counter is, for example, a pre-definable backwards counter. The details of the subroutine 200 for phase length generation are subsequently explained using FIG. 10.

Generation and output of 180 shift clock pulses SCL by the printer controller 45 then ensues in the next step 507. The shift clock pulse SCL is generated in order to further shift all pixel data for the series of heating elements to the shift register via the serial data output D. In the interrogation step 508, the phase length counter is subsequently interrogated as to whether its value PLC=0. If this is not the case, the process branches back to the beginning of the step 508. Otherwise a latch pulse is generated in the step 509. The activation of the heating elements remains unblocked by both STROBEx signals strobe1:=0 and strobe2:=0 up to the end of the last phase. During every phase, the print data for the next phase are shifted into the shift register of the print head and are transferred into the respective latch unit 12, 22 at the beginning of the next phase via a LATCH pulse.

In a step 510, the phase counter 48 is subsequently decremented by the value "1", whereby the following applies for its count value:

Phase_counter:=Phase_counter−1.

In the next interrogation step 511, the count value of the phase counter 48 is interrogated and it is checked whether the value Phase_counter="1111" (which follows the value Phase_counter="0000" given a backwards count) has already been reached. If the value Phase_counter="1111" has not yet been reached, the process branches back to the beginning of the step 505 to start the subroutine 400. Otherwise a step 512 is reached in which the signals Strobe1:=1 and Strobe2:=1 are generated and output to the driver units 13, 23 in order to end the printing of the print columns. The end is signaled to the printer controller via a signal Column-busy:=0 in the step 513. A stop of the subroutine 500 in the step 514 subsequently ensues.

A flow chart for DMA control is shown in FIG. 8. Such a subroutine 300 is invoked when a DMA start signal is output to the DMA controller 43 by the printer controller 45 (step 301). In a step 302 of the subroutine 300, a word count value W is set to the value "zero". A DMA-busy signal is set to the value "one" and transmitted to the printer controller 45. In a further step 303 of the subroutine 300, a DMA request signal $DMA_{REQ}$ with a value "zero" is transmitted to the microprocessor 6. The latter transmits an acknowledgement signal $DMA_{ACK}$ to the DMA controller 43. In a first interrogation step 304 of the subroutine 300, the process branches into a wait loop given a non-receipt of the acknowledgement signal $DMA_{ACK}$ with a value "zero". Upon receipt of the acknowledgement signal $DMA_{ACK}$ with a value "zero", the process jumps ahead from the first interrogation step 304 of the subroutine 200 to a second interrogation step 305, whereby the state of the switching signal SO is determined. If the switching signal SO has the state "one", the process branches to a third interrogation step 306. If the switching signal SO has the state "zero", then the process branches to interrogation step 309. In interrogation step 306 it is checked whether the word counter exhibits a value W smaller than forty-five. For this case (W<45), the process branches to a step 307. In the step 307, the first selection signal Sel_1.1 for the first pixel energy data preparation unit 41 of the first print column half is switched to the value "one" and the address write signal AW receives the current value W of the word counter. In the subsequent step 312, the pixel data are transferred into a buffer thus selected of the pixel energy data preparation units 41, 42. In the step 313, all selection signals are subsequently switched to the value "zero" and a DMA request signal $DMA_{REQ}$ with a value "one" is transmitted to the microprocessor.

In step 314, the word count value W is then incremented by one. In a subsequent interrogation step 315 it is then checked whether the word counter exhibits a value smaller than ninety. For this case, in which the word counter exhibits a value W<90, the process branches back to a step 303. Otherwise the process branches to a step 316 in order to output a signal DMA-busy with the value "zero" before the end (step 317) of the subroutine 300 is reached.

Otherwise, when it is established in the third interrogation step 306 that the word count value W is not smaller than forty-five, the process then branches to a step 308 in which the first selection signal Sel_2.1 for the second pixel energy data preparation unit 42 for the pixel energy data of the subsequent second print column half is switched to the value "one" and the address write signal AW receives the current value W of the word counter reduced by forty-five. In the subsequent step 312, the pixel data are again transferred into the buffer thus selected.

In the aforementioned fourth interrogation step 309, it is likewise checked whether the word counter exhibits the value W<45, and in fact when it has been established previously in the interrogation step 305 that the switching signal SO does not exhibit the state equal to one. When the word counter exhibits the value W<45, in step 310 the second selection signal Sel_1.2 for the first pixel energy data preparation unit 41 for the pixel energy data of the first print column half of a subsequent print column is switched to the value "one" and the address write signal AW receives the current value W of the word counter. In the subsequent step 312, the pixel data are again transferred into the buffer thus selected.

Otherwise, when the word counter does not exhibit the value W<45 the process branches from the fourth interrogation step 309 to a step 311 in which the second selection signal Sel_2.2 for the second pixel energy data preparation unit 42 for the pixel energy data of the subsequent second print column half of a subsequent print column is switched to the value "one" and the address write signal AW receives the current value W of the word counter reduced by the value "forty-five". In the subsequent step 312, the pixel data are again transferred into the buffer thus selected.

Figure 9:
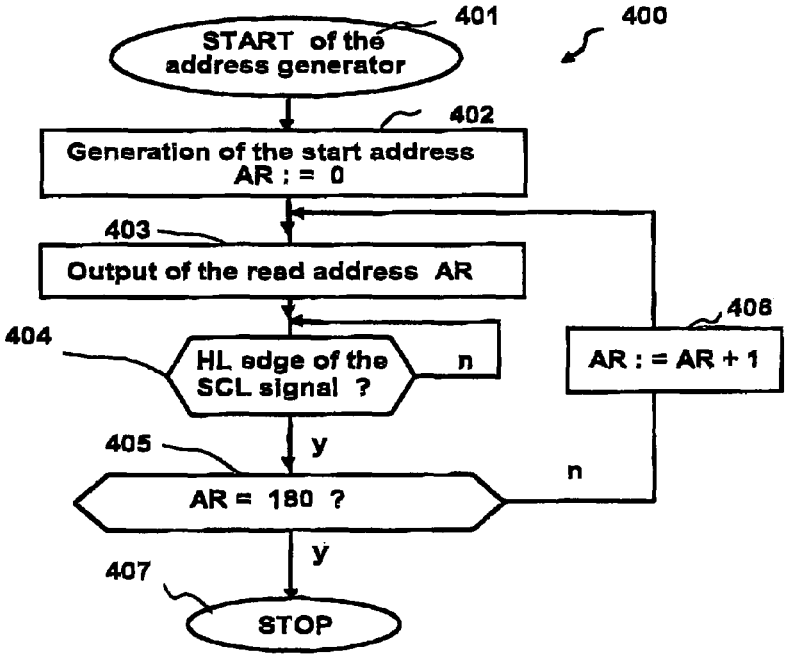
FIG. 9 is a flowchart for address generation in accordance with the present invention.

FIG. 9 shows a flow chart for address generation. The addresses of stored binary pixel energy data begin with the start address zero that is generated in the following manner for the address read signal AR. After the start in the step 401 of the address generator 44, in step 402 an initial value is invoked (AR:=0 for a counter of the address read signal AR). In the subsequent step 403, the output of the address read signal AR to the buffer ensues for its addressing. In the first interrogation step 404 it is asked whether an HL edge of the shift clock signal SCL was output to the shift register 11, 21. If this is not the case, in a wait loop the process branches back to the beginning of the interrogation step 404. If this is the case, the interrogation step 405 is executed in which it is checked whether a value of the address read signal AR=180 was reached. If this is not the case, the process branches back over a step 406 to the beginning of the step 403 for output of the address read signal AR which was incremented by one in the step 406. Otherwise the process branches to the step 407 in order to effect a stop of the subroutine 400.

Figure 10:
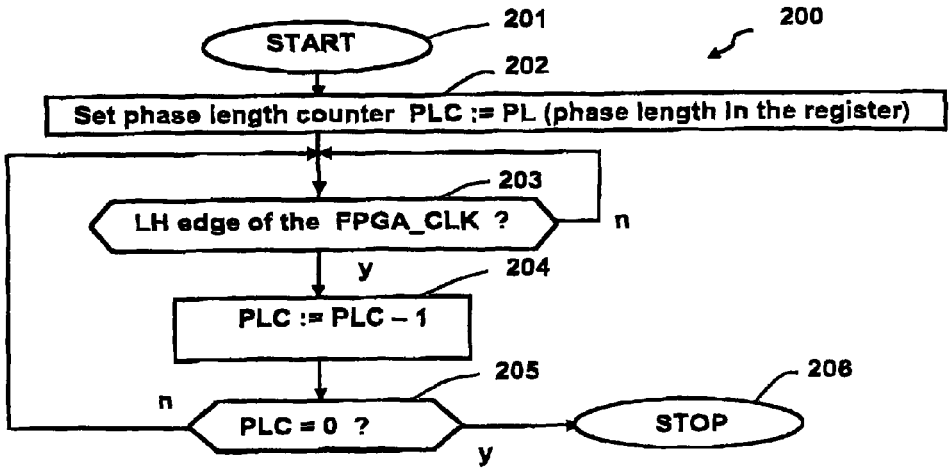
FIG. 10 is a flowchart for phase length generation in accordance with the present invention.

A flow chart for phase length generation is shown in FIG. 10. For example, the printer controller comprises a backwards counter that can be preset to a value PL, which backwards counter effects an identical time duration for each phase given the printing of dots of a column. The backwards counter operates according to the subroutine 200 and is started in the step 201. The backwards counter is set to a count value PLC:=PL in a step 202. The value PL is provided to the printer controller 45 by a register. The register value is written by the microprocessor 6 and correspondingly altered given parameter changes.

The printer controller 45 preferably is a component of an FPGA that has an internal clock generator or uses an external clock signal that generates a signal FPGA_CLK with high frequency, for example 20 MHz. If an LH edge of the signal FPGA_CLK is established by the backwards counter in the subsequent first interrogation step 203, the count value PLC is then decremented by the value "one" in the step 204. Otherwise the process branches back to the beginning of the first interrogation step 203 in a wait loop in order to await an LH edge. After the decrementing in the step 204, a further interrogation step 205 is reached in which the count state PLC=0 is interrogated. The process branches back to the beginning of the first interrogation step 203 when the count state PLC has not yet reached the value "zero". Otherwise the subroutine 200 is stopped in the step 206.

The invention is applicable both for a single thermotransfer print head with two shift registers that respectively provide pixel data for one half of a row of heating elements and form a number of such thermotransfer print heads with alignment orthogonal to the transport direction of the print matter. A number of pixel data preparation units and the special controller 43, 44, 45 and 48 are required for this.

In an embodiment variant with only a single shift register in the thermotransfer print head for an undivided row of 360 heating elements, only a single pixel data preparation unit 42 and the special controller 43, 44, 45 and 48 are required.

Independent of all embodiments, the arrangement of the pixel energy data in the pixel energy memory RAM 7 can be organized such that a change of image elements is easily possible. The print data controller for pixel data preparation during the printing with a print head thus also enables a higher flexibility with regard to the requirements of different national postal authorities for a printing mail processing apparatus.

Although modifications and changes may be suggested by those skilled in the art, it is the intention of the inventors to embody within the patent warranted hereon all changes and modifications as reasonably and properly come within the scope of their contribution to the art.

We claim as our invention:

1. A method for controlling printing by a thermotransfer printing apparatus, said thermotransfer printing apparatus comprising a print data controller and a thermotransfer print head with heating elements arranged in a row which is arranged orthogonally to a transport direction of a print medium and operated by drivers to produce printed dots for printing a printed image on said print medium, said method comprising the steps of:

in said print data controller, for each of said dots lying in a print column to be printed by said heating elements, converting a pixel energy value, that controls printing of each of said dots, into a number of binary pixel data corresponding to the pixel energy value for each of said dots, each of the binary pixel data of said number of binary pixel data having a same binary value;

incorporating each of the binary pixel data of said number of binary pixel data for heating any one heating element of said row in any one phase of a plurality of phases of a print pulse duration of a single print pulse;

supplying a plurality of binary pixel data in succession from said print data controller to said drivers wherein each of said plurality of binary pixel data is scheduled for heating a predetermined heating element for printing a dot lying in a print column n said same phase of said print pulse duration; and in said driver, energy during a plurality of phases of said single print pulse to said thermotransfer print head to produce said printed dots lying in said print column on said print medium.

2. A method as claimed in claim 1 comprising said print pulse duration in proportion to a number of said binary pixel data having a binary value of 1.

3. A method as claimed in claim 1 comprising employing a constant voltage level for said print pulse, and setting said print pulse duration to a pixel energy value A that is predetermined for each pixel by an associated code, and dividing a maximum print pulse duration in to a maximum number M of phases each of identical lengths, and presetting a phase count value B to a value M−1 and decrementing said phase count value B in steps by one and, during each phase that is set by the phase count value B, all pixel energy values A are selected in succession for printing respective dots in a print column and are compared with the current phase count value B, and generating binary pixel data with a value of "one" when the phase count value B is smaller than the selected pixel energy value A.

4. A method as claimed in claim 3 comprising employing a binary code as said code.

5. A method as claimed in claim 3 wherein said thermotransfer printhead comprises a plurality of heating elements arranged in a row for printing a plurality of columns, and wherein said method comprises electronically storing said pixel energy values column-by-column as quadruples of binary coded data, and sequentially selecting all stored quadruples of a print column containing the dot to be printed by addressing, during each phase, a number of phases that contribute to printing of dots in the print column for each of said heating elements.

6. A method as claimed in claim 5 comprising starting a print pulse duration at different points in time for respective heating elements having a different pixel energy value associated therewith, the respective print durations for the respective heating elements is different and, ending at some point of time.

7. A method as claimed in claim 1 comprising activating a strobe signal during all phases of said print pulse duration.

8. An arrangement for controlling thermotransfer printing, comprising:

a thermotransfer printer comprising a thermotransfer printhead mounted for relative movement with respect to a print medium to print onto the print medium by thermotransfer printing;

a microprocessor configured to calculate respective pixel energy values for respective pixels in an image comprised of said pixels and to code the respective pixel energy values into a number of binary pixel data, each of the binary pixel data of said number of binary pixel data having a same binary value;

a memory accessible by said microprocessor, said microprocessor being configured to store said binary pixel data for the respective pixels in said memory; and a print data controller having access to said memory, said print data controller being configured to access and decode said binary pixel data for the respective pixels to generate a signal, for each pixel, to said thermotransfer printhead that activates said thermotransfer printhead, for the respective pixels, according to the respective energy values in said thermotransfer printing on said print medium.

9. An arrangement as claimed in claim 8 wherein the print data controller comprises at least one pixel energy data preparation unit connected via a data bus with the pixel energy memory; a DMA controller; an address generator; a printer controller; and a phase counter; the DMA controller allowing an access to the pixel energy data stored as code in the pixel energy memory to provide the stored pixel energy data in print columns to the at least one pixel energy data preparation unit, and the address generator generating and emitting address read signals, for selection of the buffered code during each phase of a number of phases, and the phase counter supplying a phase count value to a phase data preparation unit in which the code value A and a phase count value B are compared in order to generated binary pixel data which are serially supplied from an output of the phase data preparation unit to at least one shift register of the thermotransfer print head, with binary pixel data with a value "one" being generated when the phase count value B is smaller than the respectively selected code value A.

10. An arrangement as claimed in claim 9 wherein a shift clock signal is applied for timing the address generator, the address generator using a LH edge of the shift clock signal.

11. An arrangement as claimed in claim 9 wherein the address generator comprises an internal clock generator for timing the address generator of the clock signal, said address generator using an LH edge immediately follows a LH edge of a shift clock signal applied to the address generator.

12. An arrangement according to claim 9, wherein the print data controller comprises a register for a register value that is set by the microprocessor, with only the register value of the print data controller being changed by the microprocessor given parameter changes.

13. An arrangement as claimed in claim 12, wherein the register value is the phase length.

14. An arrangement as claimed in claim 11, wherein the at least one pixel energy data preparation unit comprises two buffers that respectively store a predetermined number of successive data words with binary pixel data of a print column, and wherein the DMA controller and the address generator are connected in terms of control with the at least one pixel energy data preparation unit to buffer the binary pixel data per print column and in order to provide the buffered code for pixel energy data preparation during the printing, and wherein the printer controller is connected in terms of control with the DMA controller, the address generator and the pixel data preparation unit to generate binary pixel data at said output.

15. An arrangement as claimed in claim 14, wherein the buffers are dual port RAMs.

16. An arrangement as claimed in claim 14, wherein the DMA controller is connected in terms of control with the microprocessor and the buffers, and wherein the DMA controller generates and emits address write signals that, upon access to the binary pixel energy data stored in the pixel energy memory, allow writing of the binary pixel energy data into the buffers of the pixel energy data preparation unit, and wherein the DMA controller comprises a cycle counter for a predetermined number of data words.

17. An arrangement as claimed in claim 16 wherein the printer controller generates and emits a switching signal to activate the pixel energy data preparation unit, and wherein the pixel energy data with a value A are selected by one of a first or a second of the two buffers for a comparison with the phase count value B, wherein the printer controller is connected with the DMA controller via a control line for the switching signal, and wherein the DMA controller generates and emits selection signals dependent on a switching state of the switching signal to buffer the binary pixel data in said one of the first or the second of the two buffers, with the other of the first or the second of the two buffers being selected for buffering the binary pixel energy data of a print column in succession via the selection signals.

18. An arrangement as claimed in claim 17, wherein the cycle counter of the DMA controller is a word counter for a predetermined count of 16-bit data words that is started by a DMA-start signal and wherein, for generating and emitting said selection signals, DMA controller comprises an output unit and a first comparator and a second comparator, said first comparator, dependent on the SO signal, activating the output unit to emit a specific selection signal Sel_1.1 or Sel_1.2 for the first pixel data preparation unit until reaching a first predetermined number of 16-bit data words, and to emit a specific selection signal Sel_2.1 or Sel_2.2 for the second pixel data preparation unit reaching the first predetermined number of 16-bit data words, and the second comparator generating a DMA-busy signal with a value "zero" after reaching a second predetermined number of 16-bit data words, and being connected with a control line that is connected to the cycle counter to end the counting of DMA cycles.

19. An arrangement as claimed in claim 18 wherein the printer controller comprises a print column counter and connected with the encoder, said print column counter, after each printed print column, being incremented upon occurrence of an encoder clock pulse; and printing of a print image being ended when a predetermined value is reached in said print column counter.

20. An arrangement as claimed in claim 19, wherein the printer controller is directly connected with the DMA controller via control lines for first DMA control signals DMA-start and DMA-busy, the DMA-start signal being supplied by the printer controller to the DMA controller, and wherein the DMA controller emits the DMA-busy signal with a value "zero" to the printer controller to signal that direct memory access has occurred, and wherein the printer controller is connected with the address generator via a control line for supply of an address generator thereto.

21. An arrangement as claimed in claim 20, wherein the DMA controller is connected with the microprocessor via control lines for second DMA control signals.

22. An arrangement as claimed in claim 15, wherein the phase data preparation unit comprises two parallel data inputs that are connected with the outputs of both of said two buffers to provide a binary code value and a second parallel data input for a binary-encoded phase count value B and the output.

23. An arrangement as claimed in claim 8 wherein said print data controller is formed as an application-specific integrated circuit.

24. An arrangement as claimed in claim 8 wherein said print data controller is formed by programmable logic elements.

* * * * *